US010644415B2

(12) United States Patent
Nomura et al.

(10) Patent No.: US 10,644,415 B2
(45) Date of Patent: May 5, 2020

(54) TERMINAL-EQUIPPED WIRE AND METHOD FOR CRIMPING TERMINAL ONTO WIRE

(71) Applicants: AutoNetworks Technologies, Ltd., Yokkaichi, Mie (JP); Sumitomo Wiring Systems, Ltd., Yokkaichi, Mie (JP); SUMITOMO ELECTRIC INDUSTRIES, LTD., Osaka-shi, Osaka (JP)

(72) Inventors: Hideki Nomura, Mie (JP); Hiroki Hirai, Mie (JP); Junichi Ono, Mie (JP); Takuji Ootsuka, Mie (JP)

(73) Assignees: AutoNetworks Technologies, Ltd. (JP); Sumitomo Wiring Systems, Ltd. (JP); Sumitomo Electric Industries, Ltd. (JP)

( * ) Notice: Subject to any disclaimer, the term of this patent is extended or adjusted under 35 U.S.C. 154(b) by 0 days.

(21) Appl. No.: 16/099,264

(22) PCT Filed: May 9, 2017

(86) PCT No.: PCT/JP2017/017462

§ 371 (c)(1),
(2) Date: Nov. 6, 2018

(87) PCT Pub. No.: WO2017/195751

PCT Pub. Date: Nov. 16, 2017

(65) Prior Publication Data

US 2019/0140366 A1 May 9, 2019

(30) Foreign Application Priority Data

May 13, 2016 (JP) ..... 2016-097228

(51) Int. Cl.
*H01R 4/18* (2006.01)
*H01R 4/62* (2006.01)
(Continued)

(52) U.S. Cl.
CPC ..... *H01R 4/185* (2013.01); *H01R 4/62* (2013.01); *H01R 4/70* (2013.01); *H01R 43/058* (2013.01)

(58) Field of Classification Search
CPC . H01R 4/185; H01R 4/62; H01R 4/70; H01R 4/188
(Continued)

(56) References Cited

U.S. PATENT DOCUMENTS 7,402,089 B1 7/2008 Myer et al.
8,802,987 B2 * 8/2014 Morikawa ..... H01R 4/20 174/68.1
(Continued)

FOREIGN PATENT DOCUMENTS

JP 2003-297447 10/2003
JP 2008-277302 11/2008
(Continued)

OTHER PUBLICATIONS

International Search Report dated Jul. 25, 2017.

*Primary Examiner* — Travis S Chambers
(74) *Attorney, Agent, or Firm* — Gerald E. Hespos; Michael J. Porco; Matthew T. Hespos

(57) ABSTRACT

A terminal-equipped wire (X) includes a wire (10) with a core (11) covered by with insulation coating (12). A terminal (20) including a wire barrel (23) is crimped onto the core (11) exposed at an end of the wire (10). An anticorrosive (35) is attached to cover the crimped wire barrel (23). The wire barrel (23) has barrel pieces (23B) extending from side edges of a bottom plate. The core (11) is placed on the bottom plate so that a tip of the core (11) is retracted rearwardly of front edges of the barrel pieces (23B) and the barrel pieces (23B) are crimped to embrace the core (11) while extending ends of the barrel pieces (23B) butt against each other. A core confirmation opening (30) is formed in a
(Continued)

front of the crimped wire barrel (23) by widening an interval between corresponding butting parts of the barrel pieces (23B).

3 Claims, 4 Drawing Sheets

(51) Int. Cl.
*H01R 4/70* (2006.01)
*H01R 43/058* (2006.01)

(58) Field of Classification Search
USPC ..... 439/877, 878
See application file for complete search history.

(56) References Cited

U.S. PATENT DOCUMENTS

| | | | | |
|---|---|---|---|---|
| 8,870,611 | B2 * | 10/2014 | Sato | H01R 4/188 439/877 |
| 2010/0035482 | A1 | 2/2010 | Nakamura et al. | |
| 2012/0329341 | A1 | 12/2012 | Morikawa et al. | |
| 2015/0244084 | A1 * | 8/2015 | Aizawa | H01R 4/185 439/878 |
| 2015/0318654 | A1 * | 11/2015 | Kawamura | H01R 43/048 439/877 |

FOREIGN PATENT DOCUMENTS

| | | |
|---|---|---|
| JP | 2010-40404 | 2/2010 |
| JP | 2010-232119 | 10/2010 |
| JP | 2011-192530 | 9/2011 |

* cited by examiner

TERMINAL-EQUIPPED WIRE AND METHOD FOR CRIMPING TERMINAL ONTO WIRE

BACKGROUND

Field of the Invention

This specification relates to a terminal-equipped wire and a method for crimping a terminal onto a wire.

Related Art

A structure for connecting a terminal to an end of a coated wire has a terminal with a wire barrel that is caulked to a core exposed by stripping the coated wire and an insulation barrel that is caulked to an end of the remaining insulation coating. There are times when it is necessary to connect different types of metals, such as connecting an aluminum wire to a terminal made of copper. If moisture is present between contact parts of these two metals, both metals are dissolved in the form of ions into the moisture, and electrolytic corrosion occurs to corrode base metals by an electrochemical reaction.

Electrolytic corrosion conventionally is prevented by sealing a wire connecting portion (wire barrel and insulation barrel) in the terminal by an anticorrosive made of a resin mold, as described in Japanese Unexamined Patent Publication No. 2003-297447.

When caulking the wire barrel to the core of the aluminum wire, the core may be exposed excessively long due to an error in an end processing (stripping) of the aluminum wire or the tip of the core may project more than necessary from the front edge of the caulked wire barrel due to a position error or the like when the core is placed on a bottom plate of the wire barrel. If this occurs, the tip of the core may jut out from the anticorrosive even if the anticorrosive is attached to the wire connecting portion. As a result, a possibility of electrolytic corrosion due to the presence of the moisture remains.

To avoid this, it is thought to caulk the wire barrel in such a manner as to cover up to the tip of the core. However, if this is done, whether or not a necessary caulking length is ensured, i.e. whether or not a necessary fixing force is secured cannot be confirmed. Thus, this measure cannot be adopted.

This specification was completed on the basis of the above situation.

SUMMARY

A terminal-equipped wire disclosed by this specification includes a coated wire in which a core is covered with an insulation coating, a terminal including a wire barrel to be crimped onto the core exposed in an end part of the coated wire, and an anticorrosive to be attached to cover around the crimped wire barrel. The wire barrel is shaped so that two barrel pieces extend from both side edges of a bottom plate. The core is placed on the bottom plate so that a tip of the core is retracted rearward of front edges of the barrel pieces and the barrel pieces are crimped to bend and embrace the core while extending ends of the barrel pieces are butted against each other, and a core confirmation opening is formed in a front edge part of the crimped wire barrel by widening an interval between corresponding butting parts of the barrel pieces.

The core confirmation opening can be seen after the crimping of the wire barrel is completed. Thus, whether or not the tip of the core of the coated wire is located in the core confirmation opening is confirmed. Confirmation that the tip of the core is located in the core confirmation opening assures the anticorrosive is attached to cover around the wire barrel, thereby forming the terminal-equipped wire having an anticorrosive function.

The presence of the tip of the core in the anticorrosive reliably prevents the occurrence of electrolytic corrosion. Further, since the tip of the core has reached the vicinity of the front edge of the wire barrel, a necessary crimping length for the core is ensured, and a necessary fixing force is secured.

The core confirmation opening is formed in the process of crimping the wire barrel. Thus, the terminal need not be redesigned before the wire barrel is crimped.

The core confirmation opening may be gradually wider toward a front end and may open in a front edge of the wire barrel.

The core confirmation opening can be formed precisely without producing excessive stress on the barrel pieces of the wire barrel.

The invention also relates to a method for crimping a terminal onto a wire. The method includes forming a wire barrel with barrel pieces extending from both sides of a bottom plate, placing the core on the bottom plate so that a tip of the core is retracted rearwardly of front edges of the barrel pieces, crimping the barrel pieces to bend and embrace the core while extending end sides of the respective barrel pieces are butted against each other, and so that corresponding butting parts of the pair of barrel pieces are spaced apart in a front edge part of the wire barrel, thereby forming a core confirmation opening.

Accordingly, it is possible to more reliably prevent electrolytic corrosion while securing a core fixing force.

DETAILED DESCRIPTION

An embodiment is described with reference to FIGS. 1 to 4. A terminal-equipped wire X of this embodiment is configured such that a female terminal 20 is conductively connected to an end of an aluminum wire 10. An anticorrosive 35 is attached (applied) to cover around a wire connecting portion 22 in this female terminal 20.

Figure 1:
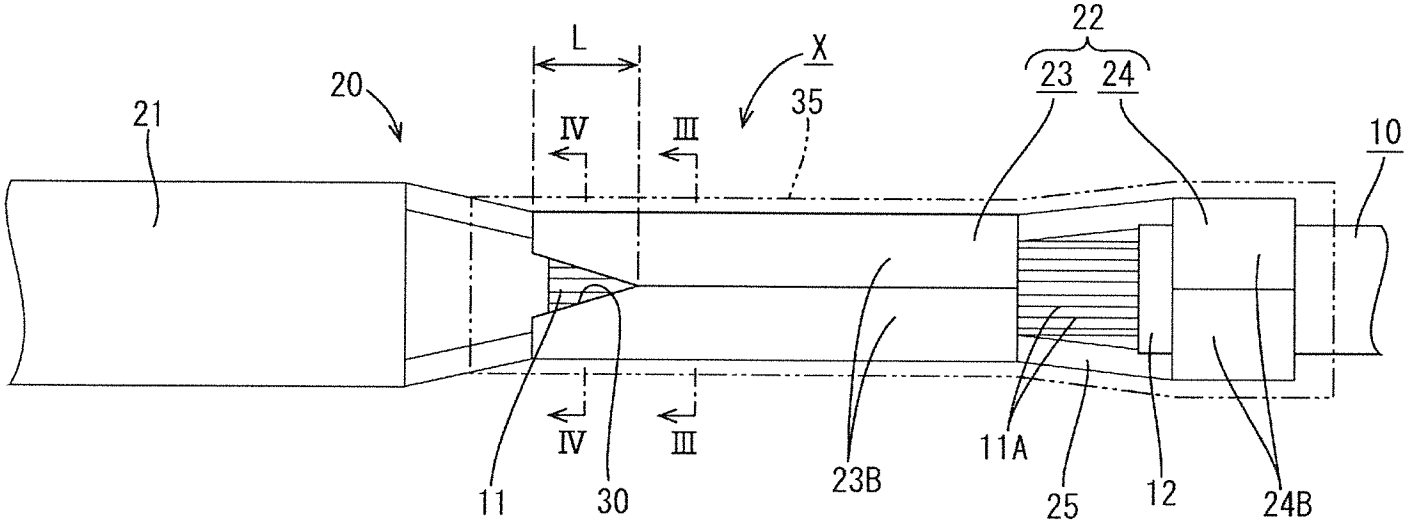
FIG. 1 is a partial plan view of a terminal-equipped wire according to an embodiment.
Figure 2:
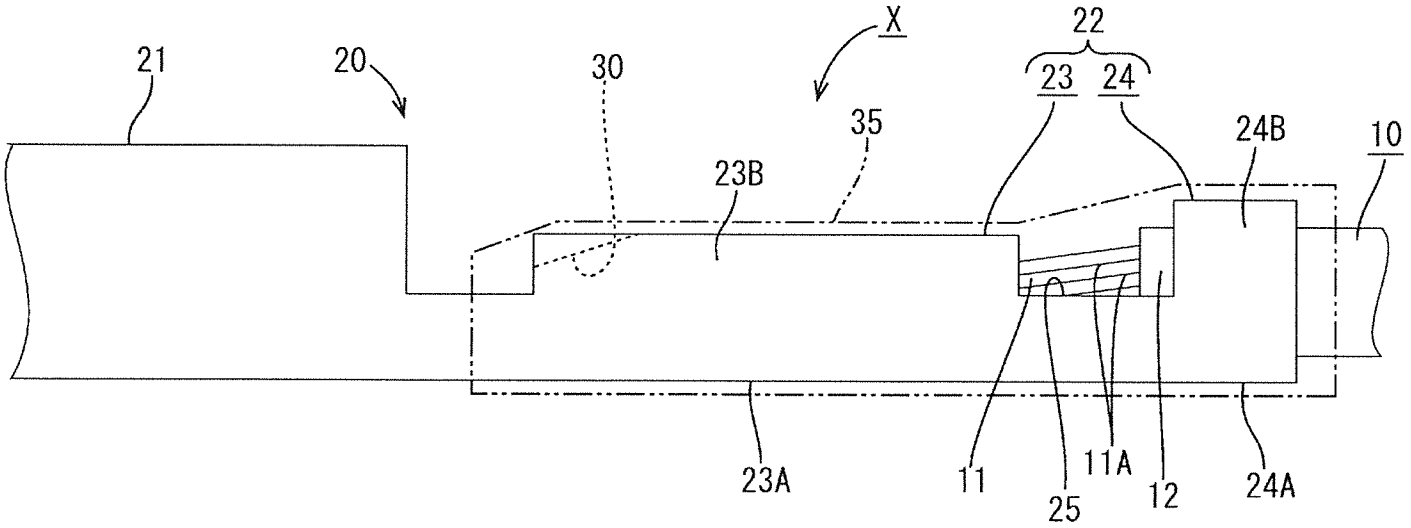
FIG. 2 is a partial side view of the terminal-equipped wire.

As shown in FIGS. 1 and 2, the aluminum wire 10 is a coated wire and is structured such that the outer periphery of a core 11 formed by bundling a plurality of metal strands 11A made of aluminum or aluminum alloy is covered with an insulation coating 12 made of synthetic resin.

In connecting the female terminal 20 to the aluminum wire 10, an end processing is performed for removing (stripping) an end of the insulation coating 12 a predetermined length to expose the core 11 on an end of the aluminum wire 10.

The female terminal 20 is formed by press-working a base material made of copper or copper alloy and is structured such that a wire connecting portion 22 to be crimped and connected to an end of the aluminum wire 10 is provided behind a terminal connecting portion 21 to be connected to a mating male terminal.

The terminal connecting portion 21 is substantially in the form of a rectangular tube and includes an unillustrated resilient contact piece inside. Electrical connection is established by inserting a tab of the mating male terminal into the terminal connecting portion 21.

The wire connecting portion 22 includes a wire barrel 23 and an insulation barrel 24 spaced apart in a front-rear direction, and the rear edge of the wire barrel 23 and the front edge of the insulation barrel 24 are coupled via a groove-shaped coupling 25.

Figure 3:
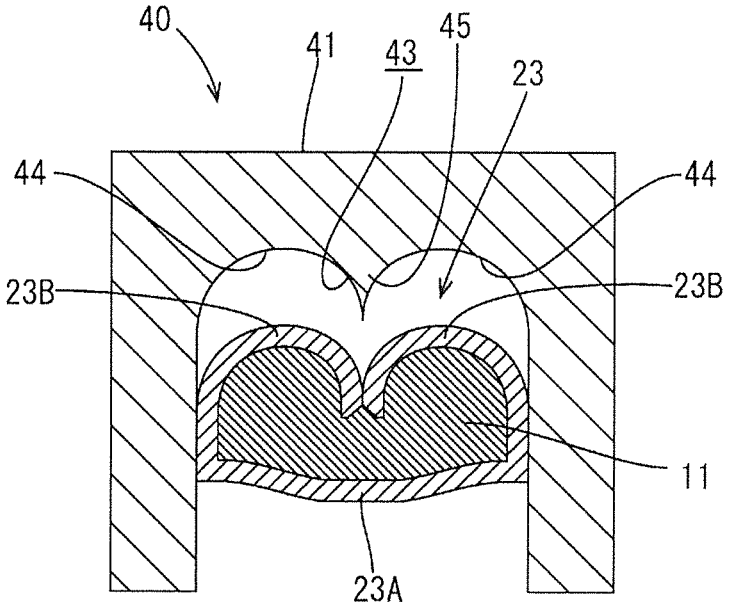
FIG. 3 is a schematic section along III-III of FIG. 1.

The wire barrel 23 functions to crimp the exposed core 11 of the aluminum wire 10 and initially is formed such that wide and short barrel pieces 23B rise from both sides of a bottom plate 23A (see FIG. 3).

The insulation barrel 24 functions to crimp an end of the insulation coating 12 remaining after the stripping processing in the aluminum wire 10, and is formed such that narrow and tall barrel pieces 24B rise from both side edges of a bottom plate 24A.

A crimping tool 40 composed of an anvil and a crimper is used for crimping the wire barrel 23 and the insulation barrel 24 in the female terminal 20 described above (see FIGS. 3 and 4 in which only a crimper 41 on the side of the wire barrel 23 is shown).

The anvil functions as a lower mold for receiving the bottom plate 23A of the wire barrel 23 and the bottom plate 24A of the insulation barrel 24 in the female terminal 20.

The crimper moves vertical above the anvil to function as an upper mold, and includes the crimper 41 on the side of the wire barrel 23 and a crimper on the side of the insulation barrel 24 as partially already described.

A crimping operation for the wire barrel 23 is performed by lowering the crimper 41 with the bottom plate 23A of the wire barrel 23 received on the anvil. Basically, as shown in FIG. 3, the left and right barrel pieces 23B are bent to embrace the core 11 while the tips thereof are butted against each other, thereby being crimped and deformed into a so-called heart shape. Thus, as shown in FIG. 3, an M-shaped crimping groove 43 is formed inside the crimper 41 with inner side edges of left and right arcuate grooves 44 connected.

Figure 4:
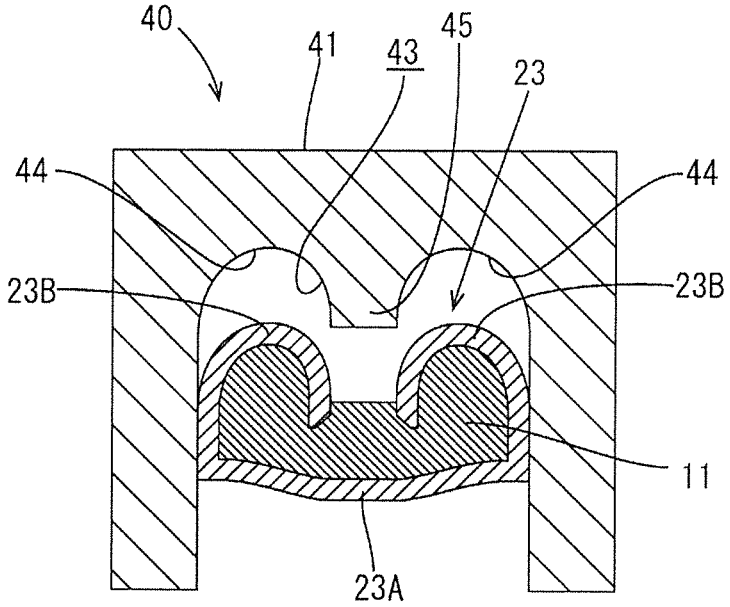
FIG. 4 is a schematic section along IV-IV of FIG. 1.

In this embodiment, the crimped shape is changed in a predetermined length area L (about 20% of the entire length) on a front edge side in the wire barrel 23. Thus, the shape of the crimping groove 43 is changed in a predetermined length area on a front end in the crimper 41. Specifically, as shown in FIG. 4, the crimping groove 43 in this area is formed to gradually widen an interval between the inner side edges while making diameters of the left and right arcuate grooves 44 gradually smaller from the rear edge toward the front edge (opening edge). Focusing on the "M shape", a part 45 projecting down in a center is formed to have a pointed tip, as shown in FIG. 3, on the rear edge and gradually widens a tip width, as shown in FIG. 4, toward the front edge.

By forming the crimping groove 43 in the predetermined length area on the front end of the crimper 41 into the above shape, the left and right barrel pieces 23B are crimped and bent to embrace the core 11 while the tips thereof are butted against each other in the predetermined length area L on the front side in the wire barrel 23, but gradually widen an interval between the corresponding tips of the respective barrel pieces 23B toward the front edge, as shown in FIG. 4. In this way, a triangular core confirmation opening 30 gradually wider toward a front side and open in the front edge of the wire barrel 23 is formed at a widthwise center position of the upper surface of a front part of the crimped wire barrel 23.

Note that, on the side of the insulation barrel 24, the left and right barrel pieces 24B are crimped to be formed into a hollow cylindrical shape and wind around the end of the insulation coating 12 while the tips thereof are overlapped each other as the crimper is lowered.

Next, functions of this embodiment are described.

First, an operation of crimping the female terminal 20 onto the end of the aluminum wire 10 is performed using the crimping tool 40. Specifically, after the bottom plates 23A, 24A extending from the wire barrel 23 to the insulation barrel 24 in the female terminal 20 are received and set on the anvil of the crimping tool 40, the exposed core 11 of the aluminum wire 10 having the end processing performed thereon is placed on the bottom plate 23A of the wire barrel 23 and the end of the insulation coating 12 is placed on the bottom plate 24A of the insulation barrel 24. At that time, the core 11 is placed on the bottom plate 23A so that the tip thereof is retracted rearward a predetermined distance from the front edges of the barrel pieces 23B.

By lowering the crimper from this state, the wire barrel 23 and the insulation barrel 24 are caulked. The insulation barrel 24 is crimped such that the left and right barrel pieces 24B are formed into a hollow cylindrical shape and wind around the end of the insulation coating 12 while the tips thereof are overlapped each other.

The wire barrel 23 is crimped so that the left and right barrel pieces 23B are bent to embrace the core 11 while the tips thereof are butted against each other as shown in FIG. 3 in a rear-most area. On the other hand, in the predetermined length area L on the front, the wire barrel 23 is crimped so that the left and right barrel pieces 23B are bent to embrace the core 11 while the tips thereof are butted against each other, but the interval between the corresponding tips of the respective barrel pieces 23B is gradually wider toward the front edge as shown in FIG. 4.

In this way, the triangular core confirmation opening 30 gradually wider toward the front and open in the front edge of the wire barrel 23 is formed at the widthwise center position of the upper surface of the front part of the crimped wire barrel 23, as shown in FIG. 1.

The presence of the tip of the core 11 in the core confirmation opening 30 can be confirmed, as shown in FIG. 1, by seeing the core confirmation opening 30. Thus, the anticorrosive 35 is attached to cover the entire wire connecting portion 22 including the wire barrel 23 as shown by chain line in FIGS. 1 and 2 utilizing an anticorrosive attaching device, and solidified. In this way, the terminal-equipped wire X having an anticorrosive function is formed.

According to the terminal-equipped wire X of this embodiment, the occurrence of electrolytic corrosion is prevented more reliably since the tip of the core 11 of the aluminum wire 10 stays in the anticorrosive 35. Further, since the tip of the core 11 has reached the position of the core confirmation opening 30, i.e. the vicinity of the front edge of the wire barrel 23, a necessary crimping length is ensured, with the result that a necessary fixing force is secured.

The core confirmation opening 30 is formed in the process of crimping the wire barrel 23. Thus, the shaped of the female terminal 20 before the wire barrel 23 (wire connecting portion 22) is crimped need not be redesigned.

The core confirmation opening 30 has a triangular shape to be gradually wider toward the front and is open in the front edge of the wire barrel 23. Thus, the core confirmation opening 30 can be formed precisely without producing excessive stress (stress concentration) on the barrel piece 23B, e.g. without causing any damage such as a crack.

The invention is not limited to the above described and illustrated embodiment. For example, the following embodiments are also included.

The shape of the core confirmation opening formed in the front edge part of the wire barrel is not limited to the triangular shape illustrated in the above embodiment, and may be another shape as long as excessive stress is not produced when the barrel pieces are crimped. Further, the core confirmation opening may be formed on the inner side of the front edge without being open in the front edge of the wire barrel.

Although a case where the anticorrosive is attached to cover the entire wire connecting portion from the wire barrel to the insulation barrel is illustrated in the above embodiment, the anticorrosive may be attached only to and around the wire barrel as long as an area where the core is possibly exposed can be covered.

Although the female terminal is illustrated as the terminal in the above embodiment, application to a male terminal including a terminal connecting portion shaped to have a projecting tab is also possible.

Although the coated wire including the core composed of a plurality of metal strands is illustrated in the above embodiment, the coated wire may include a core formed of one metal strand having a relatively large diameter, i.e. may be a single-core coated wire.

Although an assembly formed by connecting the aluminum wire and the terminal made of copper or copper alloy is illustrated as the terminal-equipped wire in the above embodiment, there is no limitation to this and the present invention can be widely applied to terminal-equipped wires in general in which a core of a coated wire and a terminal to be connected to the core are formed of different types of metals.

LIST OF REFERENCE SIGNS

X: terminal-equipped wire
10: aluminum wire (coated wire)
11: core
12: insulation coating
20: female terminal (terminal)
23: wire barrel
23A: bottom plate
23B: barrel piece
30: core confirmation opening
35: anticorrosive

The invention claimed is:

1. A terminal-equipped wire, comprising:

the wire having a core covered with an insulation coating;

a terminal including a wire barrel to be crimped onto the core exposed from an end part of the insulation coating; and an anticorrosive to be attached to cover around the crimped wire barrel;

wherein:

the wire barrel is shaped such that barrel pieces extend from both side of a bottom plate;

the core is placed on the bottom plate so that a tip of the core is retracted rearwardly of front edges of the barrel pieces and the barrel pieces are crimped from front parts to rear parts to form inwardly concave surfaces that embrace the core and outwardly convex surfaces opposite the inwardly concave surfaces, the outwardly convex surfaces of the respective barrel pieces are butted against each other along areas of the barrel pieces adjacent the rear parts and the outwardly convex surfaces of the barrel pieces including opposed facing spaced apart surface regions forward of the surfaces that are butted against each other so that a core confirmation opening is formed in the front parts of the crimped barrel pieces by widening an interval between the opposed facing surface regions forward of the butting parts of the barrel pieces.

2. The terminal-equipped wire of claim 1, wherein the core confirmation opening is shaped to be gradually wider toward a front side and open in a front edge of the wire barrel.

3. A method for crimping a terminal onto a wire by crimping a wire barrel provided in the terminal onto a core exposed from an end of an insulation coating of the wire, wherein:

shaping the wire barrel so that two barrel pieces extend from both sides of a bottom plate;

placing the core on the bottom plate so that a tip of the core is retracted rearwardly of front edges of the barrel pieces; and crimping the barrel pieces from front parts to rear parts to form inwardly concave regions of the barrel pieces that embrace the core and outwardly convex surfaces opposite the inwardly concave surfaces, the outwardly convex surfaces of the respective barrel pieces are butted against each other along areas of the barrel pieces adjacent the rear parts, and the outwardly convex surfaces of the barrel pieces forward of the butting parts of the barrel pieces are in opposed facing spaced apart relationship from the butting parts to the front parts of the crimped barrel pieces, thereby forming a core confirmation opening.

* * * * *